United States Patent [19]

Girard et al.

[11] Patent Number: 4,667,495

[45] Date of Patent: May 26, 1987

[54] KEY WITH MOVABLE PLUNGER, SECURITY BARREL FOR SAID KEY, AND A LOCK EQUIPPED WITH SUCH A BARREL

[75] Inventors: Joël Girard; Norbert Gsell, both of Abbeville, France

[73] Assignee: Vachette, Paris, France

[21] Appl. No.: 711,220

[22] Filed: Mar. 13, 1985

[30] Foreign Application Priority Data

Mar. 14, 1984 [FR] France ..... 84 03944

[51] Int. Cl.[4] ..... E05B 19/08

[52] U.S. Cl. ..... 70/398; 70/358; 70/409; 70/421

[58] Field of Search ..... 70/358, 409, 395, 398, 70/419, 421

[56] References Cited

U.S. PATENT DOCUMENTS

| | | | |
|---|---|---|---|
| 601,111 | 3/1898 | Wolfgramm | 70/419 |
| 1,494,765 | 5/1924 | Barrett | 70/409 |
| 3,877,267 | 4/1975 | Harris, Jr. | 70/411 |
| 4,341,102 | 7/1982 | Ku et al. | 70/358 |
| 4,343,166 | 8/1982 | Hofmann | 70/409 |
| 4,377,082 | 3/1983 | Wolter | 70/395 |

FOREIGN PATENT DOCUMENTS

| | | | |
|---|---|---|---|
| 2722808 | 11/1978 | Fed. Rep. of Germany | 70/358 |
| 1158653 | 1/1958 | France | 70/358 |
| 1201967 | 7/1959 | France | 70/358 |
| 2396144 | 3/1979 | France | 70/358 |
| 2492872 | 4/1982 | France | 70/409 |
| 2521201 | 8/1983 | France | 70/398 |
| 2522053 | 8/1983 | France | 70/398 |

*Primary Examiner*—Thomas J. Holko
*Assistant Examiner*—Suzanne L. Dino
*Attorney, Agent, or Firm*—Brisebois & Kruger

[57] ABSTRACT

A key comprises a key body provided with at least one translatably movable plunger able to be displaced in a housing provided in the key, the plunger being intended to co-operate with a positioning member provided in the recess of a rotor so as to project from its recess and to push a movable pin of the rotor into a position permitting rotation of the barrel rotor relative to the stator. The key comprises in its head a constricted zone, and the recess of the movable plunger is provided in this constricted zone.

13 Claims, 8 Drawing Figures

KEY WITH MOVABLE PLUNGER, SECURITY BARREL FOR SAID KEY, AND A LOCK EQUIPPED WITH SUCH A BARREL

BACKGROUND TO THE INVENTION

The invention relates to a key for a security barrel, useful in particular for the operation of a lock or of a bolt, the key being of the type in which the body of the key is intended to enter a recess of the barrel rotor and is provided with at least one translatable movable plunger able to be displaced, with a movement of limited amplitude, in a recess provided in the key, the plunger being intended to co-operate with a positioning member provided in the rotor recess so as to project outwardly from the recess and to push a movable bolt of the rotor into a position permitting rotation of the barrel rotor relative to the stator.

PRIOR ART

Patent Application FR-A No. 2,521,201 discloses a key of this type in which the recess of the movable plunger is formed in the median plane of the body of the key and opens on at least one of the two longitudinal edges of the body of the key. A groove necessary for the passage of the fixed bolt of the rotor which projects inwardly of the recess of the key is provided on the longitudinal edges of the key body. This solution is interesting and is satisfactory. However, it requires the presence of the grooves mentioned above for the passage of the fixed bolt which complicates somewhat the manufacture of the key and limits the possibility of camming hollows on these edges. Furthermore, the movable plunger may project transversely relative to the maximum transverse dimension of the key; as a result of this there is a risk of catching of the movable plunger on the walls defining the rotor recess during entry of the key into the recess; in practice it is necessary to provide a frusto-conical surface at this entrance, this surface constituting a type of ramp over which the movable plunger slides in its recess for the case where the plunger extends beyond the recess. Such a frusto-conical surface, provided on the barrel, at the entrance for the key takes up room along the axial direction and is furthermore visible from the exterior such that one could deduce that the key intended to operate the barrel is a key comprising a movable plunger, and this amounts to a disadvantage.

European Patent Application EP-A No. 0 029 498 discloses a lock comprising a key provided with a movable plunger formed by a rolling member such as a ball which is housed within the thickness of the key such that the diameter of this ball must necessarily be small. As a result of this there are difficulties in providing the recesses and the end of travel stops which must be very precisely dimensioned. Furthermore, in order to permit passage of the fixed bolt of the rotor which projects within the recess of the key, it is necessary to provide a rectilinear groove which, in this case, will be formed on one of the two large flat faces of the body of the key, this groove having formed within it the recess for the movable plunger. This groove reduces the possibilities of installing keying members between the rotor and the stator of the barrel.

OBJECTS OF THE INVENTION

The invention aims, above all, to provide a key of the type defined above which is better adapted to the various practical requirements than those presently available and which does not present the disadvantages mentioned above, or does so to a small degree. It is desirable, in particular, that the manufacture of the key should be relatively simple and that it should not be necessary to provide a conical surface at the entry of the recess for the key due to the fact that there is a movable plunger on this key. It will be remembered that the presence of such a movable plunger of coded length complicates considerably copying of the key which includes it, and this considerably increases the security for the user of a key of this type.

SUMMARY OF THE INVENTION

According to the invention, a key for a security barrel usable in particular for the operation of a lock or of a bolt, of the type defined above, is characterised by the fact that it comprises, in its head, a constricted zone and by the fact that the recess for the movable plunger is provided in this constricted zone.

Preferably, the transverse dimensions of this constricted zone and the operation of the movable plunger and of its recess are such that as the plunger leaves its recess to the maximum extent, said plunger does not project transversely relative to the contour of the transverse cross-section of the rest of the key.

Thus, the risks of catching upon entry of the key into the barrel are reduced or eliminated such that it is not necessary to provide a conical surface at the entrance for the key.

The key may have a flat elongate form; in this case the constricted zone of the key has the same thickness as the rest of the key but is reduced in width, the axis of the recess for the movable plunger extending transversely relative to the longitudinal direction of the key and being substantially parallel to the median plane of the body of the key. Generally the recess for the movable plunger opens at its two ends on the edges of the constricted zone.

In a variant, the key may have a cylindrical form; in this case, the constricted zone also has a cylindrical form, the diameter of this constricted zone being less than that of the rest of the key; preferably, the constricted cylindrical zone is co-axial with the rest of the key. Advantageously, the recess for the movable plunger has its axis oriented along a diameter of the cylindrical constricted zone.

The movable pins of the rotor intended to define a plurality of tumbler members and able to co-operate with hollow formations provided on the key are advantageously placed in the radially oriented recess whose axes intersect the longitudinal axis of the rotor.

In the case of a cylindrical form of key, the recess for the key is a bore concentric to the rotor and there is practically no zone denied for the recesses for the movable pins of the rotor which gives numerous possible combinations for positioning the recesses for the pins.

The invention also concerns a security barrel intended in particular for a lock or a bolt, said barrel being adapted to be moved by a key with movable plunger as defined above.

Such a security barrel comprises a stator and a rotor, the rotor comprising towards its end remote from the entrance of the recess of the rotor a positioning member for partially displacing the movable plunger of the key from its recess, and a movable pin of the rotor on which the movable plunger may act, this movable pin of the rotor being capable of co-operating with a stator pin resiliently biased against the rotor.

The invention also concerns a lock or a bolt equipped with a barrel intended to be operated by a key of the type defined above.

BRIEF DESCRIPTION OF THE INVENTION

Further objects and advantages of the present invention will become apparent from the following description, given merely by way of non-limiting example, of particular embodiments described with reference to the attached drawings.

IN THE DRAWINGS

FIG. 1 of these drawings is a plan view, with parts removed, of a flat key in accordance with the invention;

DESCRIPTION OF THE PREFERRED EMBODIMENTS

Figure 1:
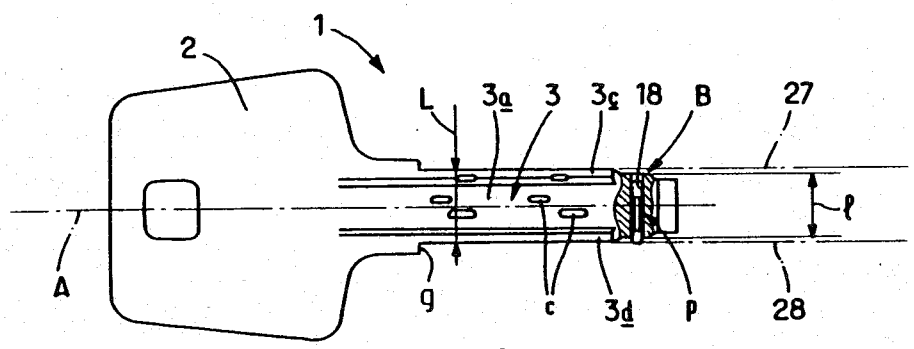
Figure 3:
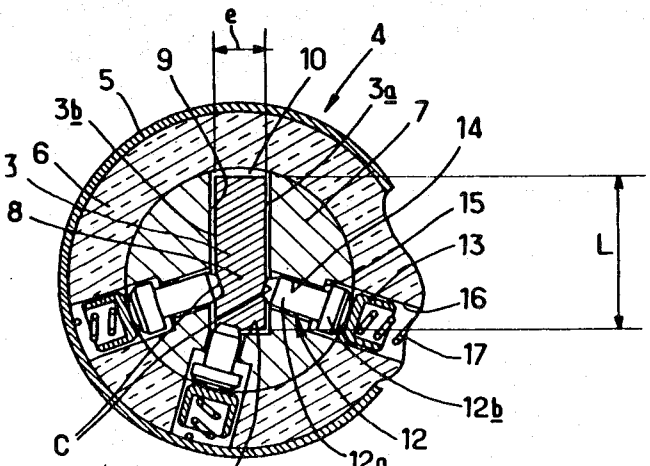
FIG. 3 is a large scale cross-section along the line III—III of FIG. 2, with the key introduced in the barrel.

Referring now to the drawings, and in particular to FIG. 1, it is possible to see a key designated 1 in its entirety which comprises, in the conventional manner, an operating plate 2 intended to be gripped in the hand by a user, and a key body 3 whose general form is flat. In other words, the transverse cross-section of the body of the key is substantially rectangular as schematically shown in FIG. 3, this body presenting two large flat faces 3*a*, 3*b*. In this case, the small sides 3*c*, 3*d* (FIG. 1) connecting these large faces may be slightly curved, in particular externally convex, and may project as shown in FIG. 1.

The key 1 is intended to co-operate with a barrel 4 (FIGS. 2 to 4) useful in particular for a lock or a bolt (not shown). The barrel 4 comprises a stator envelope 5, a cylindrical stator 6 having a cross-section in the form of a circular annulus and a rotor 7 in the form of a circular cylinder mounted in the cylindrical bore of the stator 6 with the possibility of rotation about the common geometrical axis 8. The rotor 7 comprises a recess 9 whose transverse cross-section is rectangular, as shown in FIG. 3, and is greater than that of the key body 3 such that the key body is able to enter this recess 9. This recess is formed by a longitudinal groove formed in the barrel 7 and opening with a peripheral opening 10 on the external cylindrical surface of the barrel 7. The wall of the recess 9 opposite this opening 10 constitutes the floor 11 of the recess.

Several tumbler members are provided between the rotor 7 and the stator 6 so as to form a combination which will only allow rotation of the rotor 7 when the appropriate key 1 has been introduced in the recess 9. These tumbler members are provided by movable pins such as 12 (FIG. 3) of the rotor associated with a corresponding movable pin 13 of the stator. The movable rotor pin 12 is mounted slidingly in a recess 14 provided in the rotor 7, this recess comprising two sections of different diameters defining between them an annular shoulder 15. The recess 14 opens, by its smaller diameter section, into the interior of the recess 9 and by its larger diameter section on the external cylindrical surface of the rotor 7. The pin 12 comprises two parts of different diameters corresponding to those of the two recess sections 14, namely a part forming a rod 12*a* and a part forming a head 12*b*. This head 12*b* is in abutment with the stator pin 13 formed by a type of hollow cap mounted slidingly in a recess 16 of the stator and elastically pushed by a spring 17 against the head 12*b*. For a predetermined angular position of the rotor 7 relative to the stator 6, shown in FIG. 3, the recesses 14 and 16 have their axes aligned. Advantageously the axes of the recesses 14 as well as the axes of the recesses 16 intersect the longitudinal axis 8 of the rotor 7.

When the key body 3 is not introduced into the recess 9, the head 12*b* of each movable pin of the rotor is pushed by the stator pin 13 against the shoulder 15. The depth of the large diameter section of the recess 14 is greater than the thickness of the head 12*b* such that the stator pin 13 penetrates into the large diameter section of the recess 14, the diameter of the recess 16 being the same as that of this section. As a result full rotation of the barrel 7 relative to the stator 6 is prevented by the stator pin 13. When the key body is introduced into the recess 9, the movable rotor pins 12 are urged back against the springs 17 and, if they do not co-operate with a hollow c (FIGS. 1 and 3) specially provided to be associated with the pin 12 in question, the head 12*b* of this pin projects into the stator recess 16 and prevents the relative rotation of the rotor 7 and of the stator 6.

It is only when the key 1 occupies the appropriate position and that all of the pins 12 co-operate with the associated hollows c (FIG. 1) that the abutment surfaces between the heads 12*b* and the stator pins 13 are on the cylindrical surface of the rotor 7; it will then be possible to turn the rotor 7 relative to the stator 6 by grasping the plate 2. It should be noted that, as shown in FIG. 3, the movable rotor pins 12 may co-operate not only with the hollows c provided on the large faces 3*a*, 3*b* of the key 3, but also with hollows provided on the side 3*d* of the key 1, even when the key body 3 is provided with a translatable movable plunger p (FIGS. 1 and 4), or on the edges of the key.

Figure 2:
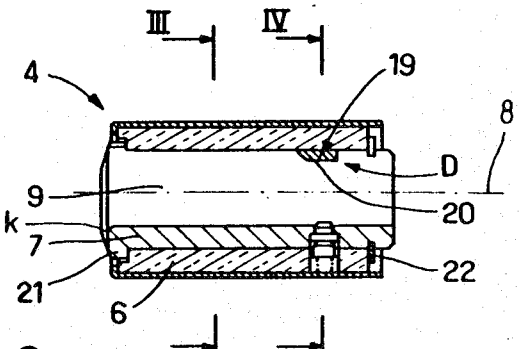
FIG. 2 is a simplified axial section of the barrel intended to co-operate with the key of FIG. 1.

This is possible for the key 1 comprises a constricted zone B in its head, that is to say towards its end remote from the plate 2, and a recess for the movable plunger p is provided in this zone B. This plunger p is intended to co-operate with a positioning member D formed, on FIGS. 2 and 4, by a pad 19 trapped in a cut-out provided in the opening 10 of the recess 9 and projecting radially inwardly by a rib 20. The external surface of the pad 19 conforms to the cylindrical surface of the rotor 7 so as not to hinder rotation of the rotor relative to the stator. The pad 19 is fixed on the rotor 7 by any appropriate means, notably by force-fitting in the cut-out of this rotor. As shown in FIG. 2, the axial holding of the rotor 7 relative to the stator 6 is ensured on the one hand by a flange 21 provided at an end of the rotor and co-operating with the stator and, on the other hand, by a circlip 22 co-operating with the other end of the stator 6.

Figure 4:
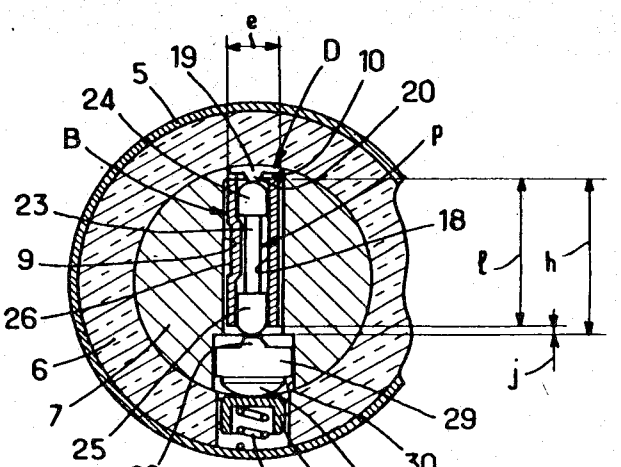
FIG. 4 is a cross-section similar to FIG. 3 but on line IV—IV of FIG. 2.

As can be seen by comparing FIGS. 3 and 4, the constricted zone B of the key has the same thickness e (FIG. 4) as the rest of the key (FIG. 3) but the width 1 (FIG. 4) of this constricted zone is reduced relative to the width L of the rest of the key. The axis of the recess 18 extends transversely relative to the longitudinal direction of the key and is substantially parallel to the median plane of the body 3 of the key. Preferably, the axis of the recess 18 is situated in the median plane of the body of the key and is perpendicular to the longitudinal direction of the key. The recess 18 opens, at its two ends, on the edges of the constricted zone B.

As shown in FIG. 4, the plunger p may comprise a rod 23 including at each end a head 24, 25 of much greater diameter; a recessed zone 26 may be formed on one of the faces, for example the face 3*b* of the key body, such that a projecting part of it may be formed, in the recess 18, between the heads 24, 25 to limit the amplitude of sliding of the movable plunger p and to prevent this presser from escaping from its recess 18. Each head 24, 25, comprises a cylindrical part ending at a rounded substantially hemispherical part.

The axial length h of the plunger p is preferably greater than the width 1 of the constricted zone B by a value j which will be explained later. The length h is less than the width L of the key body; furthermore, the form of the plunger p as well as that of the deformed portion 26 and the dimensions of this deformed portion which limit sliding displacement of the plunger p in the recess 18 are chosen so that when the plunger p projects from its recess 18 to the maximum extent it does not project beyond the contour of the transverse cross-section of the rest of the key. In other words, in the illustration of FIG. 1, the plunger p when it projects from its recess 18 to the maximum extent remains entirely comprised between the two straight lines 27, 28 tangent to the contour of the transverse cross-section of the key body 3.

Preferably, the positioning member D becomes flush with the constricted zone B when the key is introduced into the rotor recess. When the head 24 (FIG. 4) of the plunger p abuts against the rib 20, the head 25 projects by a distance j from the housing 18, from the opposite side, so as to press a rotor tumbler pin 29 in a position permitting rotation of the barrel rotor 7 relative to the stator 6. The value of the distance j is chosen so as to be sufficient to ensure correct control of the displacement of the pin 29. This pin is mounted radially slidingly in a housing 30 provided in the rotor 7, diametrically opposite the pad 19. The pin 29 comprises, at the side of the head 25 of the plunger p, a protuberance 29*a* capable of cooperating with this head and at the other end a cylindrical cap 29*b* capable of co-operating with a stator pin 31 biased by a spring 32. As in the case of the pins 12 described above, the height of the pin 29 is less than that of the recess 30 so that when the plunger p is not acting on the pin 29 the stator pin 31 projects into the recess 30 and prevents rotation of the rotor 7 relative to the stator 6.

It should be noted that instead of providing for a flush configuration of the rib 20 with the associated edge of the zone B one could instead ensure the entrance of the rib 20 into the recess 18 by virtue of a longitudinal groove portion provided solely at the level of the zone B; in this case, the length h of the plunger p may be equal to or less than the width l of the constricted zone.

Preferably the key 1 is symmetrical with respect to the longitudinal axis A (FIG. 1) such that the key may be introduced in the rotor 3 either in the position shown on FIG. 1 or in a position removed from that of FIG. 1 by 180° of rotation around the axis A, that is to say that there will not be any particular orientation of the key in the barrel. One may alternatively provide for asymmetry with a system preventing mistaken use, requiring entry of the key 1 into the rotor 7 according to a predetermined orientation.

Given the above, the functioning of a lock equipped with a barrel intended to be controlled by a key such as described above is as follows.

When the key body 3 is withdrawn from the recess 9 of the rotor 7 the latter is prevented from rotating around its axis relative to the stator by the fact that the stator pins 13, as explained above, partially project into the recesses for the associated rotor tumbler pins. These internal recesses for the rotor pins, preferably frusto-conical as shown in FIG. 3, project inwardly of the recess 9.

The introduction of the key body 3 into the recess 9 with a view to making the rotor turn and to operating the lock will provoke recoil of the rotor pins 12 into their recess.

Slightly before the end of introduction of the key body 3 into the recess 9, an end of travel which is determined by the abutment of a shoulder such as g (FIG. 1) of the key against a corresponding shoulder k of the rotor, the movable plunger p will come into contact by its end 24 or 25 with the ramp-forming rib 20 of the pad 19 (FIGS. 2 and 4). The plunger p will then adopt the position shown in FIG. 4 and its head 25 or 24 will project from the recess 19 and displace the movable rotor pin 29 by a distance sufficient for the engagement surface between the stator pin 31 and the rounded rotor tumbler pin head 29 to be at the interface of the rotor 7 and the stator 6. Simultaneously, for this end of travel position of the key, all the other rotor tumbler pins 12 will co-operate with their associated recessed portions c of the key body 3 and will occupy positions such as those shown on FIG. 3. It will then be possible, by applying a rotational moment on the plate 2 of the key to drive the rotor 7 for rotation relative to the stator 6 and thus to operate the lock.

It is to be noted that during introduction of the key into the recess 9, due to the fact that the plunger p does not project beyond the lines 27, 28 (FIG. 1) there is practically no risk of this plunger catching on entry into the recess 9, this entry therefore not needing to have a cutaway form provided with ramp-like surfaces.

Referring now to FIGS. 5 to 8, one can see an alternative embodiment in which the key 101 has a cylindrical form, that is to say that the key body 103 is formed by a cylindrical rod. The key and barrel elements of FIGS. 5 to 8 which are identical to, or play analogous roles with, the elements already described with reference to FIGS. 1 to 4 have been designated by a corresponding reference increased by one hundred from the reference designating that element on FIGS. 1 to 4. The description of these elements will not be repeated or will be only very briefly repeated.

Figure 5:
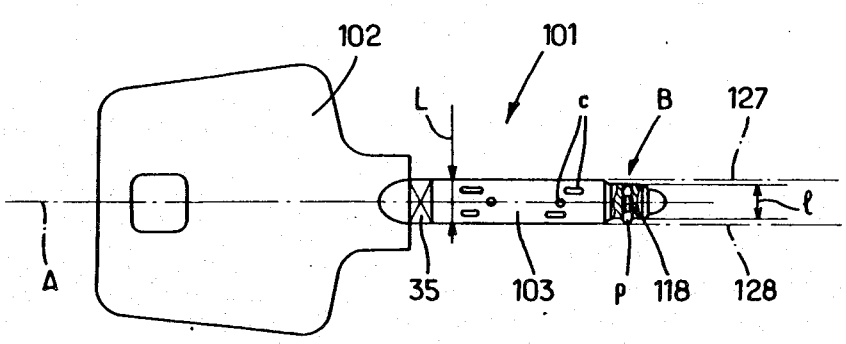
FIG. 5 is a plan view, with parts removed, of a cylindrical form of key or a round key according to the invention.

The constricted zone B of the round key 101 of FIG. 5 has the form of a circular cylinder co-axial with the rod body 103 and having a diameter less than that of the body 103. The recess 118 of the movable plunger p preferably has its axis oriented along a diameter of the constricted cylindrical zone B. As explained above, the plunger p has only limited displacement from its recess, such that it remains between the lines 127, 128 extending the two diametrically opposite generatrices of the body 103 situated in the plane passing through the common axis A and the recess axis 118.

Figure 6:
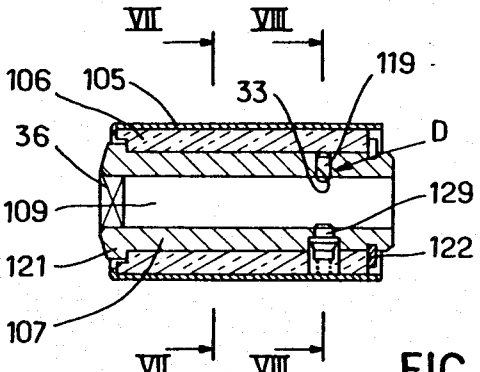
FIG. 6 is a simplified axial cross-section of the barrel intended to co-operate with the key of FIG. 5.
Figure 8:
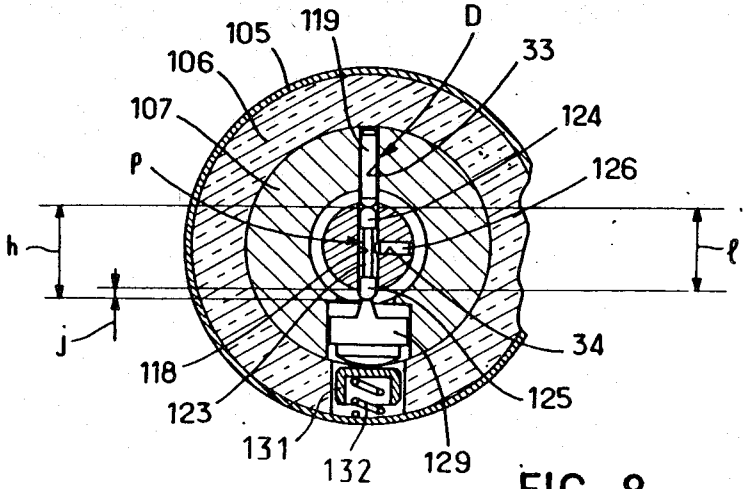
FIG. 8 is, finally, a cross-section along line VIII—VIII of FIG. 6, on a very large scale, showing the barrel in which the key has been introduced.
Figure 7:
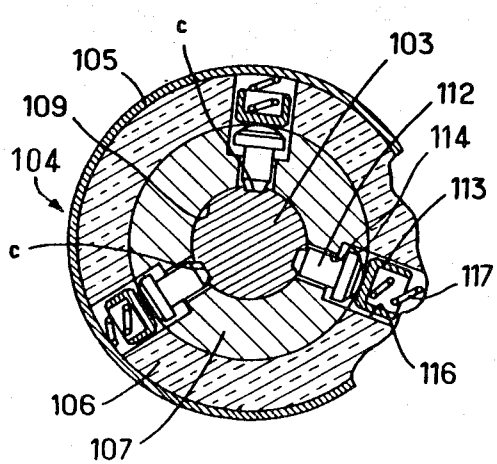
FIG. 7 is a large scale cross-section along line VII—VII of FIG. 6, of the barrel with the key introduced in this barrel.

As shown on FIGS. 6 to 8, the recess 109 for the key, provided in the rotor 107, is formed by a bore concentric to the rotor. There is thus no opening, comparable to the opening 10 of FIG. 3, of the bore 109 at the interface between the rotor 107 and the stator 106. As a result there is the advantage that in the case of the rounded key, as compared with the flat key, there is no zone denied for the angular positioning of a rotor pin. The cylindrical key body 103 also has no edge which limits the position of these pins.

Because of this, with a key having a cylindrical body 103 the possibilities for placing the pins are increased and thus the possible variations of combinations of the keys are greater.

As shown in FIG. 6, the positioning member D intended to co-operate with the movable plunger p is formed by a peg 119 mounted in a radial bore 33 provided in the wall of the rotor 107 and diametrically opposite to the movable pin 129 of the rotor. This bore 33 is provided towards the extremity of the rotor 107 remote from the entrance of the recess 109.

The movable plunger p is formed by a rod 123 provided with two heads 124, 125 identical to the rod 23 and to the heads 24, 25 of FIG. 4. The limitation of transverse movement of the rod 123 is ensured by a peg 126 housed in a radial bore 34 (FIG. 8) provided in the small diameter zone B. The axis of the bore 34 is perpendicular to the axis of bore 118, and intersects this axis. The bore 34 opens at the surface of the zone B. The peg 126 does not project to the external surface of this zone B.

The key 101 comprises, at the junction of the body 103 and of the plate 102, two diametrically opposed flats such as 35 intended to co-operate with two other flats such as 36 (FIG. 6) provided at the entrance of the rotor recess 109. This co-operation of flats ensures the correct angular position of the key 101 relative to the rotor which permits complete introduction of the key into the rotor and the co-operation of the rotor pins 112 with the associated recessed portions c provided on the key body 103.

The functioning and manipulation of the barrel and of the lock using the round key 101 are substantially the same as those described above for the flat key 1.

It should be noted that the introduction of the round key 101 in the recess 109 can be effected without adjusting the angle of introduction. The body 103 of the key is simply inserted until the flats 35 arrive at the level of the flats 36. It is sufficient then to give the key 101 the correct orientation for the flats 35 to be able to be introduced between the flats 36 which permits completion of the insertion of the key body 103 into the recess 109.

The final phase of insertion of the key body 103, in the appropriate angular position, provokes co-operation of the peg 119 and the movable plunger p (FIG. 8) which pushes the movable pin 129 of the rotor. Simultaneously, the other movable pins of the rotor co-operate with the associated hollows c of the body 103. It is thus possible to be able to turn the rotor to operate the lock.

It should be noted that for the manufacture of a round key in accordance with the invention and of the corresponding rotor the same material is used as for the flat key.

It will result from the explanation above that the invention allows the presence of a groove along the total length of the key body to be avoided, and increases the number of zones for possible positioning of the rotor pins. The risk of catching of the movable plunger against the entrance of the rotor housing being practically eliminated, it is not necessary to provide at this entrance a frustoconical or relieved surface intended to serve as ramp for the plunger.

Picking a lock equipped with such a barrel according to the invention is made very difficult by virtue of the numerous pins in all directions and by virtue of the movable system at the end of the barrel.

The hollows or indentations c may be provided in a multitude of positions in longitudinal and angular directions at one time, and may have variable depth.

We claim:

1. In a key for a rotatable security barrel for a lock or bolt, said key comprising:

(a) a key body, which is intended to enter the barrel rotor;

(b) recess means in the key body;

(c) plunger means in the recess means;

(d) means mounting the plunger means for translational movement of limited amplitude in said recess means, said plunger means being intended to co-operate with a positioning member in the barrel rotor recess, to be driven to project outwardly from said recess means and to push a movable pin of the barrel rotor into a position permitting rotation of the barrel rotor relative to a surrounding stator;

the improvement wherein the key body comprises a constricted zone at which the recess means for the movable plunger means is provided, and wherein the transverse dimensions of said constricted zone and the mounting means for the movable plunger means in said recess means are effective to ensure that when the plunger means projects out of said recess means to the maximum extent possible, said plunger means projects transversely relative to the key body no further than the contour of the transverse cross-section of the rest of the key body.

2. A key according to claim 1, wherein said key body has an elongate flat form, and said constricted zone of the key body has the same thickness as the rest of the key body but is reduced in width; and wherein the axis of the recess means for the movable plunger means extends transversely relative to the longitudinal direction of the key body and is substantially parallel to the median plane of the key body; and wherein said recess means has two opposite open ends which open at the edges of the constricted zone.

3. A key according to claim 1, wherein the key body is of cylindrical form, and the constricted zone is also of cylindrical form, the diameter of said constricted zone being less than that of the rest of the key body.

4. A key according to claim 3, wherein said constricted cylindrical zone of the key body is co-axial with the rest of the cylindrical key body.

5. A key according to claim 3, wherein said recess means for the movable plunger means has a longitudinal axis oriented along a diameter of said constricted cylindrical zone of the key body.

6. A key according to claim 3, in which the movable plunger means comprise a rod with two enlarged ends, and including a peg projecting into the recess means to limit movement of the rod transversely of the key body, said peg being housed in a bore in the key body which is radial to the said recess means.

7. A key according to claim 1, wherein the movable plunger means has an axial length which is greater than the width of the constricted zone but is less than the width of the key body.

8. A security barrel and key for a lock or bolt comprising, in combination, a key having a key body;

a security barrel having a stator and a rotor, said rotor having a recess to receive said key body;

recess means in the key body;

plunger means in the recess means of the key body;

means mounting the plunger means for translational movement of limited amplitude in said recess means;

cam means in said rotor for displacing said moveable plunger means of the key body from its recess means;

a movable pin in said rotor positioned to be driven by the moveable plunger means when the moveable plunger means is displaced by said cam means, to release the rotor for rotation relative to said stator, and wherein the key body comprises a constricted zone at which the recess means for the movable plunger means is provided, the transverse dimensions of said constricted zone and the mounting means for the movable plunger means in said recess means being effective to ensure that when the plunger means projects out of said recess means to the maximum extent possible, said plunger means projects transversely relative to the key body no further than the contour of the transverse cross-section of the rest of the key body.

9. A security barrel and key according to claim 8 wherein, said cam means is situated toward a rearward end of the recess of the rotor remote from a key inlet end of the recess.

10. A security barrel and key according to claim 8 wherein the cam means is in register with the constricted zone of the key when the key is introduced into the recess of said rotor.

11. A security barrel and key according to claim 10, wherein the key has a flat body and the cam means is formed on a plate captive in a cut-out in the opening of the rotor housing.

12. A security barrel and key according to claim 11, wherein the key body is cylindrical and the cam means comprises a peg mounted in a bore in the wall of the rotor in a radial direction of the rotor.

13. A security barrel and key according to claim 8 wherein movable tumblers of the rotor comprise pins placed in recesses oriented radially of the rotor on axes which intersect the axis of rotation of the rotor.

* * * * *